United States Patent [19]

McIntyre

[11] 4,283,873

[45] Aug. 18, 1981

[54] BREECH LOADING SHOTGUN OR THE LIKE

[76] Inventor: Jack McIntyre, P.O. Box 491, Troy, N.C. 27371

[21] Appl. No.: 46,956

[22] Filed: Jun. 8, 1979

[51] Int. Cl.[3] ..... F41C 11/10

[52] U.S. Cl. ..... 42/45; 42/12; 42/41

[58] Field of Search ..... 42/45, 44, 41 R, 12, 42/70 E

[56] References Cited

U.S. PATENT DOCUMENTS

| | | | |
|---|---|---|---|
| 150,538 | 5/1874 | Dane | 42/44 |
| 485,043 | 10/1892 | Jonson | 42/44 |
| 1,070,965 | 8/1913 | Jones | 42/70 E |
| 3,561,149 | 2/1971 | Center | 42/44 |

*Primary Examiner*—Charles T. Jordan

*Attorney, Agent, or Firm*—Joseph H. Heard

[57] ABSTRACT

Sliding movement of the trigger guard of the firearm controls desired aspects of the operation of its firing and breech-locking mechanisms. Improvements are provided in a firing mechanism of the type that is maintained in a cocked condition by a toggle linkage; and in the breech-mounting, shell-extracting, cocking and breech-locking mechanisms of a firearm of the side-opening type.

12 Claims, 15 Drawing Figures

Fig. 10
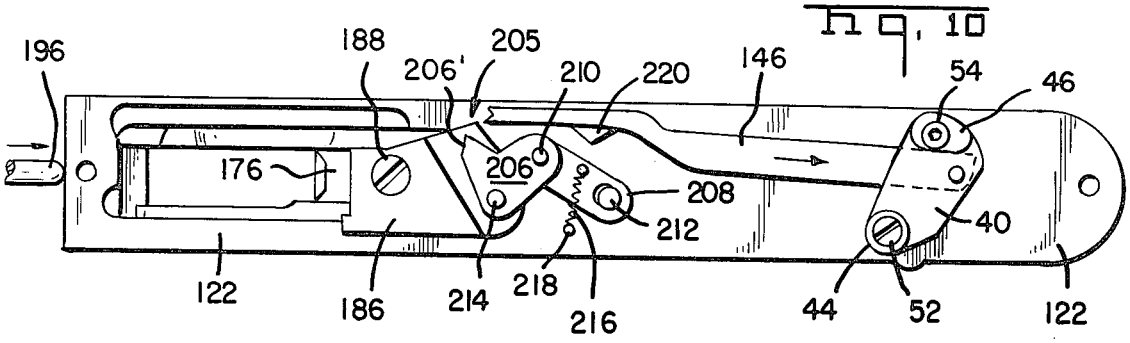
Fig. 11
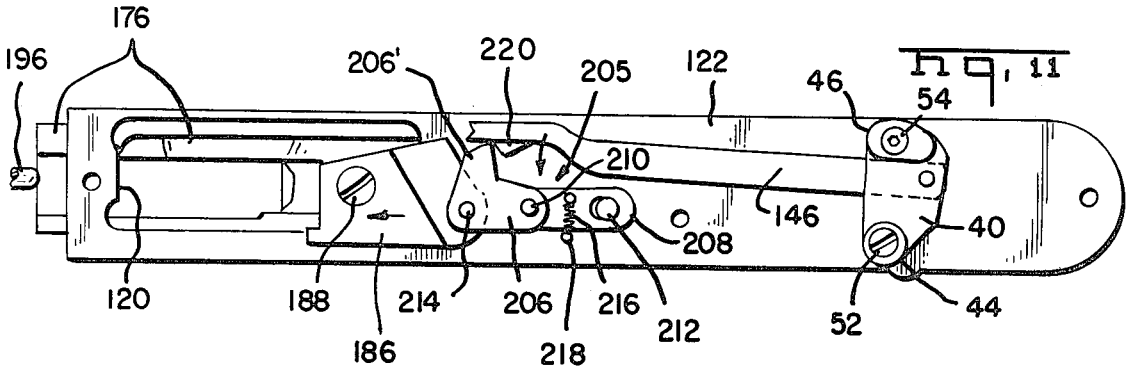
Fig. 12
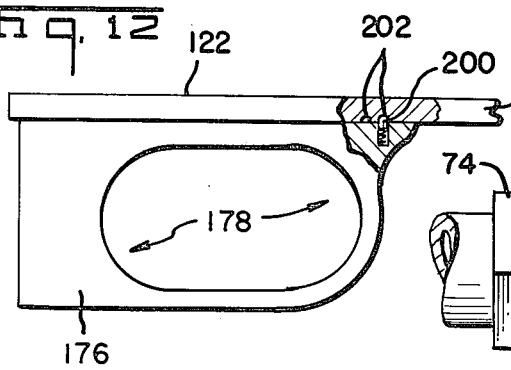
Fig. 13
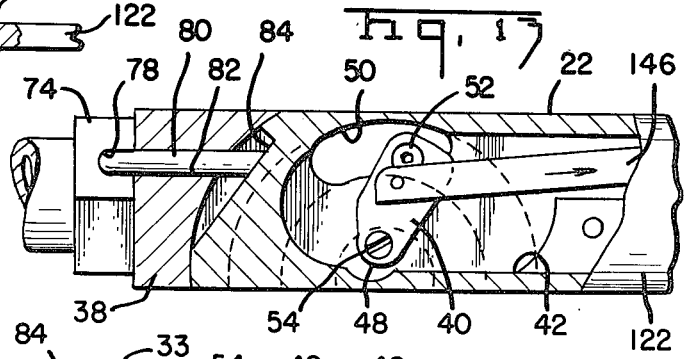
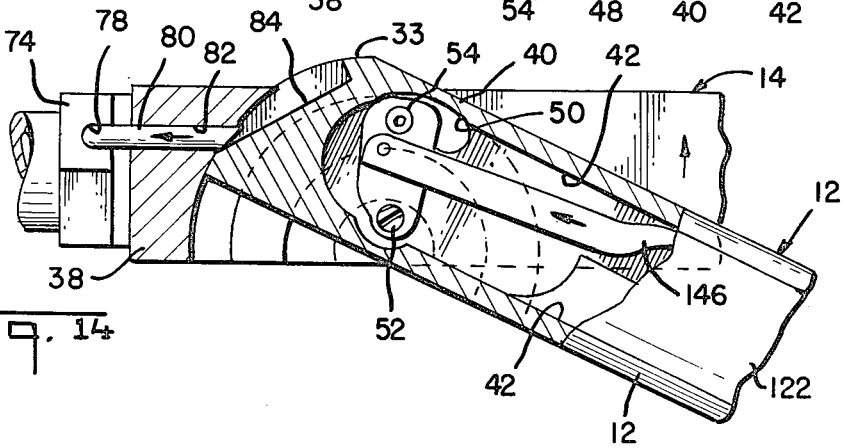
Fig. 14

BREECH LOADING SHOTGUN OR THE LIKE

BACKGROUND OF THE INVENTION

This invention relates to breech loading shotguns or similar firearms employed for sporting purposes. The invention more specifically relates to a firearm having, in addition to other novel features, a trigger guard that is slidably movable longitudinally of the firearm and is so innerconnected to its firing and breech-locking mechanisms as to control the operation of both of such mechanisms in certain desired respects.

THE PRIOR ART

Firearms employing extendable and collapsable toggle linkages in firing or other mechanisms thereof are disclosed in U.S. Pat. Nos. 3,707,976, 2,978,825, 2,659,172, 2,249,232, 2,249,231, 1,855,547 and 338,247.

Firearms having side-opening breech assemblies are disclosed in U.S. Pat. Nos. 3,557,482, 1,476,125, 1,435,573, 1,196,035, 414,213; and in British Pat. No. 306,918 and 1282 (dated Mar. 16, 1882).

Firearms having trigger guards whose movement affects the operation of either a firing mechanism or a breech locking mechanism are disclosed in U.S. Pat. Nos. 3,964,200, 3,561,149 and 485,0434. "Safety" mechanisms that include means movable into abutment with trigger members are also disclosed in U.S. Pat. Nos. 3,713,242, 2,874,503 and 1,070,965.

U.S. Pat. No. 3,636,646 discloses a firearm breech locking mechanism that includes a pair of locking pins that are movable from a retracted position within the fixed block of the breech assembly to an extended position wherein the pins are received within aligned bores of the movable block of the breech assembly.

SUMMARY OF THE INVENTION

The shotgun or the like of the present invention includes a trigger guard member that is slidably movable longitudinally of the gun between first, second and third spaced positions, and that is cooperable with components of both the firing and the breech locking mechanisms of the gun. Movement of the trigger guard to its first position retracts the gun's breech locking mechanism and renders its firing mechanism inoperable in at least one respect and, preferably, in two separate ways. Movement of the trigger guard assembly to its second position extends the breech locking mechanism while still maintaining the firing mechanism inoperable in at least one respect. Movement of the trigger guard assembly to its third position permits operation of the firing mechanism, which operation is initiated in conventional fashion by a user of the gun pulling upon a trigger section encircled by the trigger guard. Preferably the first and third positions of the trigger guard assembly are its rearmost and forwardmost ones respectively; and the second position, which is that normally occupied by the trigger guard, is an intermediate one. Such arrangement permits a user of the gun to rapidly place the firing mechanism in an operable condition, and then operate the same, since the required forward movement of the trigger guard and the rearward movement of the trigger can both be effected while the user's trigger-finger is disposed within the conventional central opening of the trigger guard. Additionally, such arrangement minimizes the possibility of a user of the firearm inadvertently pulling the trigger while moving the trigger guard rearwardly back to a "safe" position, since when used to impart rearward movement to the trigger guard, the user's finger would normally be disposed exteriorly of the trigger guard opening into which the trigger projects.

The trigger guard preferably is biased from its first position and to its second position, so as to insure that the breech assembly of the gun will always remain in a closed and locked condition except when opening of the breech, as for purposes of reloading, is desired. While positive effort is required to move the trigger guard to its third position, the trigger guard is automatically retained in such position, by a toggle linkage connected thereto, pending opening and closing of the gun's breech assembly.

In its preferred embodiment, the gun of the present invention also incorporates improvements in various other of its mechanisms. The movable and fixed breech members are mounted for movement relative to each other by rugged and durable mounting means that, among other things, minimizes the travel and insures continued stability of the movable breech member during opening of the breech assembly. The shell extractor mechanism of the gun is of economical and durable construction, and includes an extractor member which in the closed condition of the breech assembly also functions to prevent vertical displacement between the fixed and movable breech members during firing of the gun. The cocking mechanism operates automatically upon opening of the breech assembly and includes a member so cooperable with the toggle linkage connected to the gun's trigger guard as to effect, upon closing of the breech assembly, return biased movement of the trigger guard assembly to its second position and substantially simultaneous movement of the breech locking mechanism to its extended position. The firing mechanism of the gun preferably also includes a toggle linkage for maintaining each firing pin of the gun in a cocked position, and improved means engageable with a projecting end portion of a pivot pin of each toggle linkage for effecting collapse thereof and ensuring firing of the gun in response to pulling of the trigger.

DESCRIPTION OF THE DRAWINGS

Still other features of the invention will be apparent from the following description of an illustrative embodiment thereof, which should be read in conjunction with the accompanying drawings, in which:

FIG. 3 is an enlarged exploded perspective view of the fixed and movable members of the breech assembly of the gun, the movable breech member being rotated ninety degrees for clarity of illustration, showing the means mounting such members for movement relative to each other.

FIG. 9 is an enlarged exploded perspective view of components of the firing, breech-locking, cocking and extractor mechanisms of the gun;

FIG. 10 is a top plan view of the gun's bottom frame plate and associated components, including the trigger guard and a toggle linkage connected thereto;

FIG. 11 is a view similar to FIG. 10, but showing the trigger guard and associated components in different positions;

FIG. 12 is a fragmentary side-elevational view of the bottom frame plate and of the trigger guard of the gun, partially broken away to show detent means associated therewith;

FIGS. 13 and 14 are fragmentary views, partially in bottom plan and partially in horizontal section, taken substantially along the line 13—13 of FIG. 4 and showing components of the shell extractor and cocking mechanisms in the positions which they occupy when the breech assembly is closed (FIG. 13) and open (FIG. 14)

DESCRIPTION OF THE PREFERRED EMBODIMENT

Figures 1, 2:
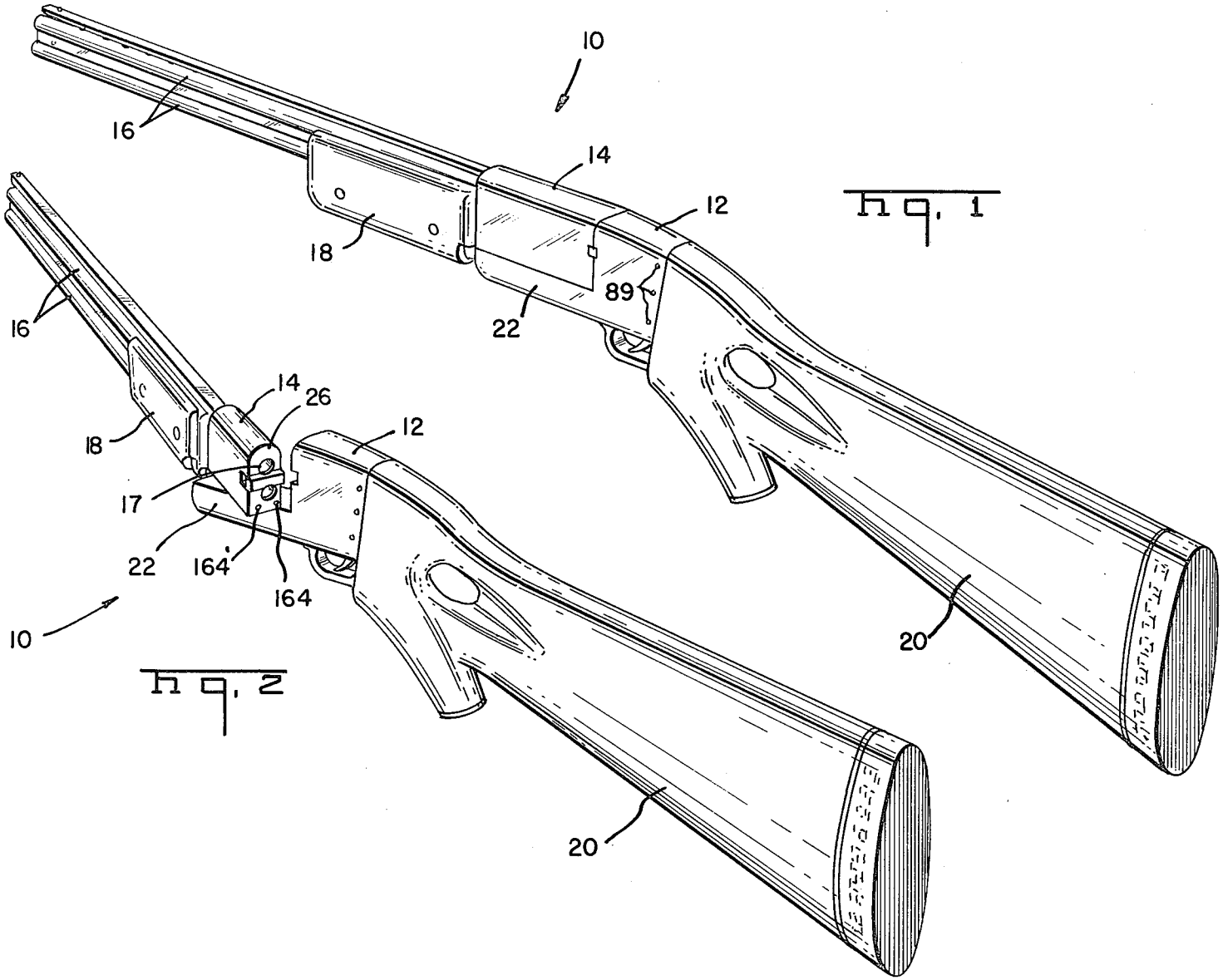
FIG. 1 is a perspective view of a shotgun constructed in accordance with the present invention.
FIG. 2 is a perspective view of the FIG. 1 shotgun with its breech assembly in an open position.
Figure 7:
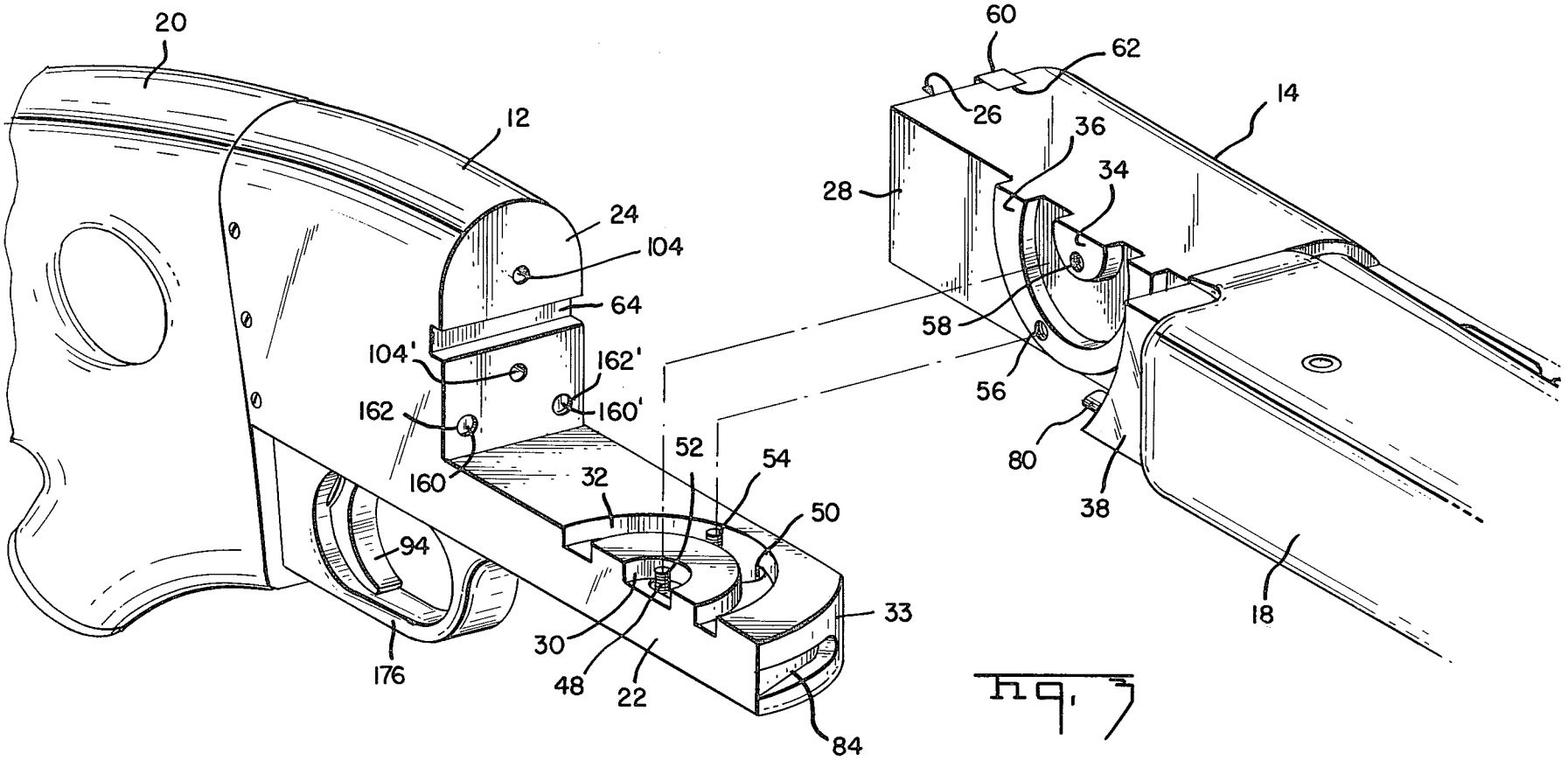
FIG. 7 is a view similar to FIG. 4 but showing the position occupied by components of the firing mechanism after firing of the upper barrel of the gun.

Although various of the improvements of the present invention are applicable to other types of firearms, they are depicted in the drawings in association with a breech-loading, side-opening, superimposed-barrel shotgun, designated in its entirety in FIGS. 1 and 2 by the numeral 10, such shotgun illustratively being adapted for use by a left-handed person. The frame of gun 10 includes relatively movable breech block members 12, 14 that collectively define an openable and closable breech assembly. Barrels 16 are formed integrally with breech member 14 and communicate at their rear ends with respective ones of superimposed shell-receiving chambers 17 extending through member 14. The frame of gun 10 further conventionally includes a forestock 18 extending along a rearward portion of lower barrel 16, and a buttstock 20 connected to and extending rearwardly from breech member 12.

Referring now also to FIG. 3, breech member 12 includes a shelf-like section 22 that projects horizontally forwardly from a vertical front wall 24 of the rear section of such member. The upper surface of section 22 and the forward surface of wall 24 of breech member 12 are respectively of the same exterior dimensions as rear surface 26 and a lower surface 28 of breech member 14. Breech member 14 is supportively mounted upon section 22 of breech member 12 for pivotal movement between closed and open positions, respectively shown in FIGS. 1 and 2, about a vertical pivot axis located at the right side edge of members 12, 14 and spaced in a longitudinal direction forwardly of and distally from vertical wall 24 of member 12 and vertical rear surface 26 of member 14. The mounting means employed for the foregoing purpose includes (see particularly FIG. 3) radially spaced semicircular grooves 30, 32 extending within the upper surface of section 22 of member 12 from the right side edge thereof, and an arcuate front surface 33 of section 22. Grooves 30, 32 and surface 33 are each centered about the aforesaid pivot axis of the breech assembly, and therefore are concentric with one another. The mounting means further includes semicircular projections 34, 36 upon surface 28 of member 14, which projections are complementary with respective ones of the grooves 30, 32 of section 22 of member 12, and the rear surface of a downwardly projecting forward section 38 of member 14, which surface has an arcuate configuration complementary to that of forward surface 33 of member 12. In the assembled condition of the breech assembly, surface 28 of member 14 rests upon the upper surface of section 22 of member 12; projections 34, 36 are matingly received within grooves 30, 32 respectively; and the arcuate rearward surface of section 38 of member 14 closely overlies arcuate forward surface 33 of section 22 of member 12. Additionally, when the breech assembly is closed, the vertical rear surface 26 of member 14 extends in closely adjacent parallel relationship to vertical wall 24 (FIG. 3) of member 12. Pivotal movement of the breech assembly between its FIG. 1 closed position and its FIG. 2 open position occurs freely notwithstanding the flat configuration of the aforesaid surfaces of members 12, 14, due to the pivot axis of the assembly being at one side edge thereof; and the location of the aforesaid pivot axis in forwardly spaced distal relationship to surface 26 and wall 24 minimizes the arcuate distance through which member 14 must be moved to effect full opening of the breech assembly. This enhances the ease and speed with which the breech assembly may be opened and closed, and also insures that member 14 continues to be firmly supported by member 12 even when the breech assembly occupies its fully open position of FIG. 2.

Breech members 12, 14 are secured in assembled relationship to each other by a clamping plate 40 (see particularly FIGS. 9–11, 13 and 14) located within the forward part of a shallow recess 42 provided within the bottom of breech member 12 and extending along most of the length thereof. Upstanding lugs 44, 46 of clamping plate 40 project freely through respective enlarged openings 48, 50 (see also FIG. 3) provided within section 22 of breech member 12. Screw-type fasteners 52, 54 extend freely through countersunk bores within respective ones of the lugs 44, 46 and thence into aligned threaded bores 56, 58 (FIG. 3) within the semicircular projections 34, 36 of breech member 14. When screws 52, 54 are tightened, plate 40 clamps members 12, 14 vertically together without impeding free pivotal movement of the breech assembly of gun 10 between its open and closed positions of FIGS. 1 and 2. Plate 40, and more specifically its lug 46, also prohibits pivotal movement of the breech assembly beyond its closed (FIGS. 1 and 13) and fully open (FIGS. 2 and 14) positions. When the breech assembly reaches either of such positions, then-ensuing abutment between lug 46 and one or the other end of the arcuately shaped opening 50, best shown in FIGS. 13 and 14 and through which such lug projects, prohibits movement of the breech assembly therebeyond.

As will be appreciated by those skilled in the art, firing of shotgun 10 momentarily subjects breech member 14 to large-magnitude forces tending to upwardly displace its rear vertical surface 26 relative to the confronting wall 24 of breech member 12. In accordance with one aspect of the present invention, the possibility of any such vertical displacement occurring between breech members 12, 14 during firing of gun 10 is negated by a block-like shell extractor member 60 constituting part of the gun's shell extractor mechanism. When the breech assembly of gun 10 is closed, extractor member 60 extends between and is closely and jointly received by confronting slots 62, 64 respectively provided within and across the width dimensions of rear surface 26 of breech member 14 and the forward surface of wall 24 of breech member 12, at an elevation approximately midway the height of such surfaces. Extractor member thus functions as a "key" positively preventing any vertical displacement between the aforesaid surfaces of breech members 12, 14 when gun 10 is fired. The additional components of the shell extracting mechanism of gun 10, to be now described (see particularly FIGS. 4, 9, 12 and 13) include a pair of rod elements 66 that are connected to extractor member 60 and project forwardly therefrom through and beyond suitable bores extending longitudinally through breech member 14. Each rod 66 has a shoulder-like abutment 70 thereon and is slidably engaged, forwardly of such abutment, by the adjacent one of a pair of upstanding arms 72 of a generally U-shaped yoke member 74 pivotably connected by a pivot pin 76 to front section 38 of breech member 14. A blind bore 78 within a lower part of yoke member 74 receives the forward end portion of a plunger 80 that extends through an aligned bore 82 within section 38 of breech member 14. The forward end portion of plunger 80 projects into a horizontally extending cam slot 84 within arcuate front surface 33 of section 22 of breech member 12. When the breech assembly of shotgun 10 is fully closed, the aforesaid components of the shell extractor mechanism occupy their positions illustrated in FIGS. 1, 4, 6–8 and 13 of the drawings. Upon opening of the breech assembly of shotgun 10 (see FIG. 14), plunger 80 is cammed forwardly by the vertical surface of cam slot 84, and pivots yoke member 74 about the axis of pin 76 (FIG. 4) in a direction causing its upstanding arms 72 to engage the shoulder-like abutments 70 upon rods 66 and to move such rods rearwardly. This in turn causes extractor member 60 to move to its extended position of FIG. 2 and, during such movement, to partially extract from chambers 17 of breech member 14 any shell that might be present within either of such chambers. During closure of the breech assembly of shotgun 10, the vertical surface of slot 64 (FIG. 3) of breech member 12 reengages extractor member 60 and cams the same back to its original position of FIGS. 1, 4 and 6–8. The return movement of extractor member 60 produces forward movement of rods 66 that in turn restores yoke 74 and plunger 80 to the positions thereof respectively illustrated in FIGS. 4 and 13.

The firing mechanism of shotgun 10 includes, as is best shown in the exploded perspective view of FIG. 9, forward and rearward base members 86, 88, respectively; upper and lower firing pin members 90, 90', respectively; upper and lower toggle linkage means 92, 92', respectively; a trigger member 94; and a firing lever 96 connected to and extending upwardly from trigger member 94. Base member 86 is removably mounted in any suitable manner within that hollow portion of breech member 12 immediately rearwardly of its wall 24 and, as is apparent from FIGS. 4 and 6–8, extends in abuting parallel relationship to the rear surface of such wall. The forward part of base member 88 is removably mounted within the rear opening of breech member 12, as by screws 89. The rearward part of member 88 is secured within a suitable cavity of buttstock 20 by an elongate bolt 98 (FIG. 4) that extends through the pistol-grip portion of the buttstock and into a threaded bore within member 88. Upper firing pin 90 is mounted for sliding movement within aligned upper bores 100, 102 and 104 extending respectively through base member 88, base member 86 and wall 24 of breech block member 12. Lower firing pin 90' is similarly mounted within aligned lower bores 100', 102' and 104' of the aforesaid components. Coil springs 108, 108' encircle reduced diameter sections of pins 90, 90' within bores 100, 100' of base member 88, and are compressed by rearward movement of pins 90, 90' to their retracted or "cocked" positions of FIGS. 4, 6 and 8. Block-like members 110, 110', fixedly secured to medial sections of pins 90, 90', have recesses 112, 112' within their right sides. The rear end portions of toggle linkages 92, 92' are pivotably mounted within recesses 112, 112' by pins 114, 114', and the linkages' forward end portions are pivotably connected to the right side of bracket member 86 by similar pins 116, 116', respectively. The center pivot pins 118, 118' of toggle linkages 92, 92' differ from those at the opposite ends of the linkages, in that each pin 118, 118' extends not only through the linkage with which it is associated, but also projects laterally outwardly a short distance from the right side of such linkage.

Figure 4:
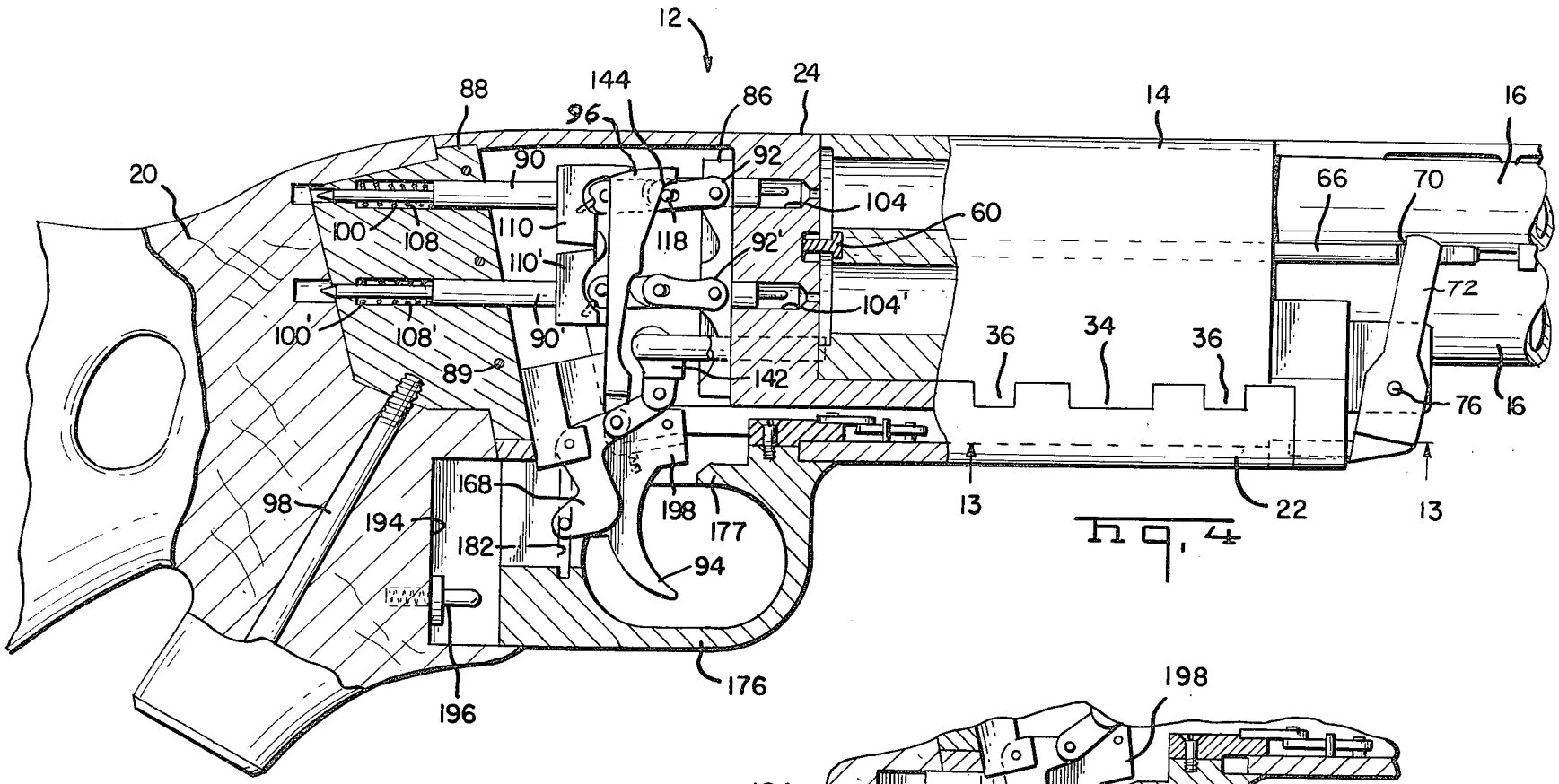
FIG. 4 is an enlarged fragmentary right-side elevational view, with some components partially broken away to disclose interior mechanisms, of the firearm in a ready-to-fire condition.
Figure 6:
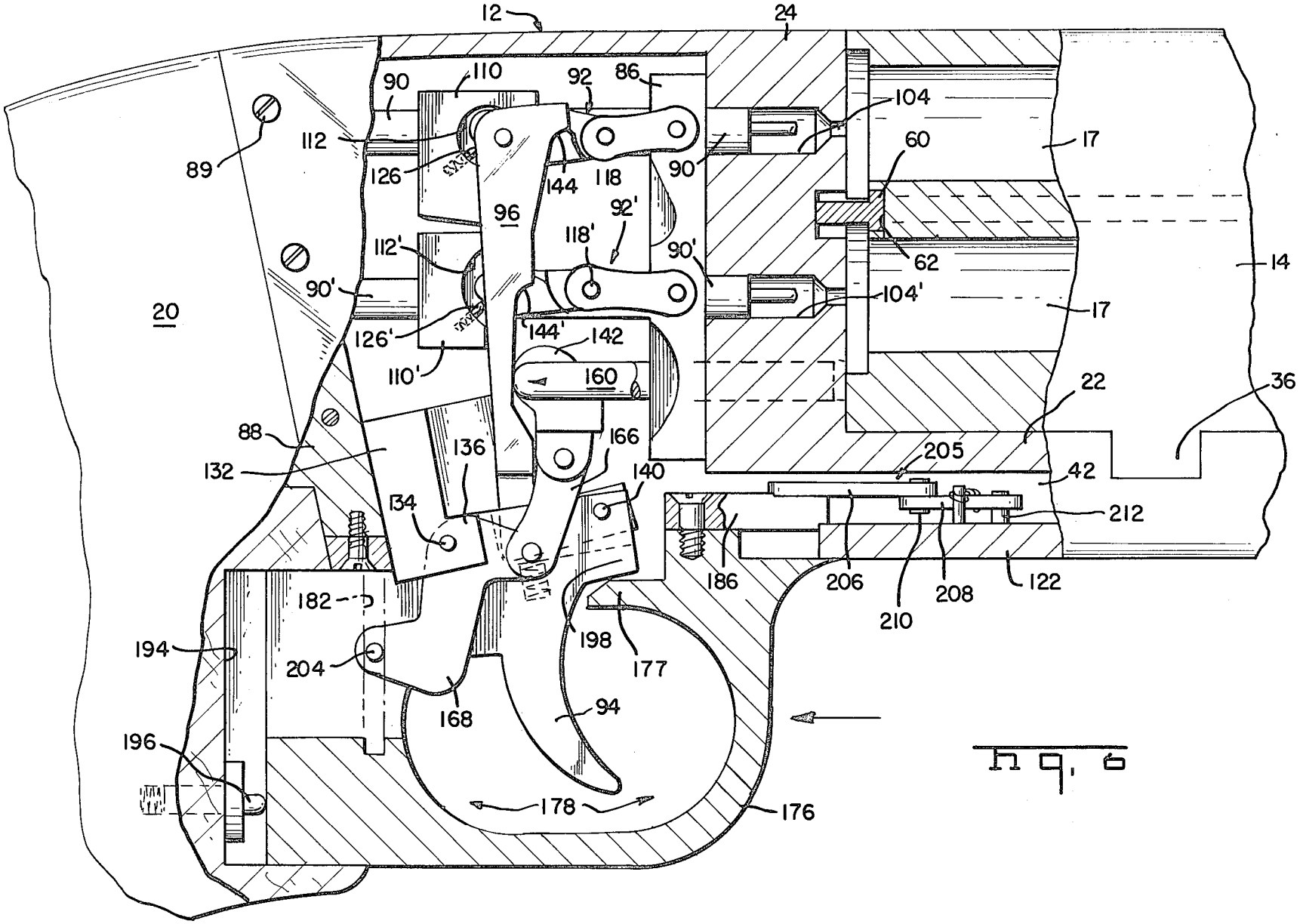
FIG. 6 is a further enlarged fragmentary side elevational view, with some components partially broken away, showing the trigger guard and other components of the firearm in the positions occupied thereby when the breech-locking mechanism is retracted.
Figure 7:
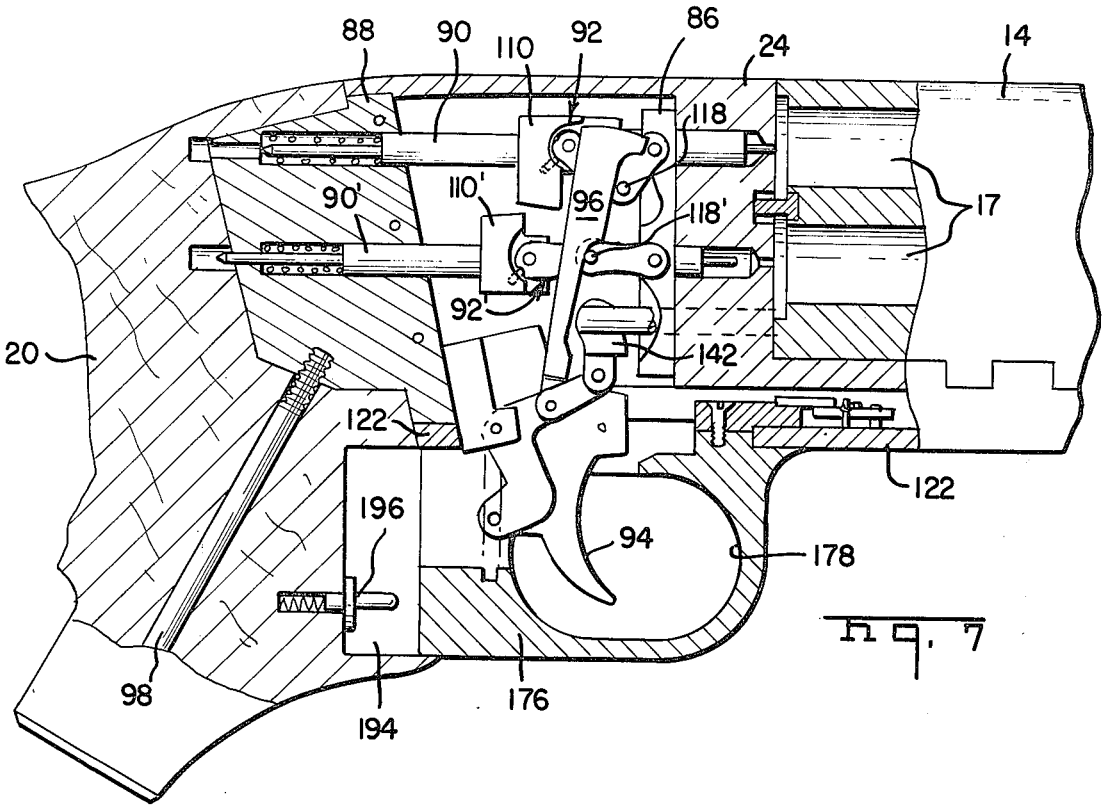
Figure 8:
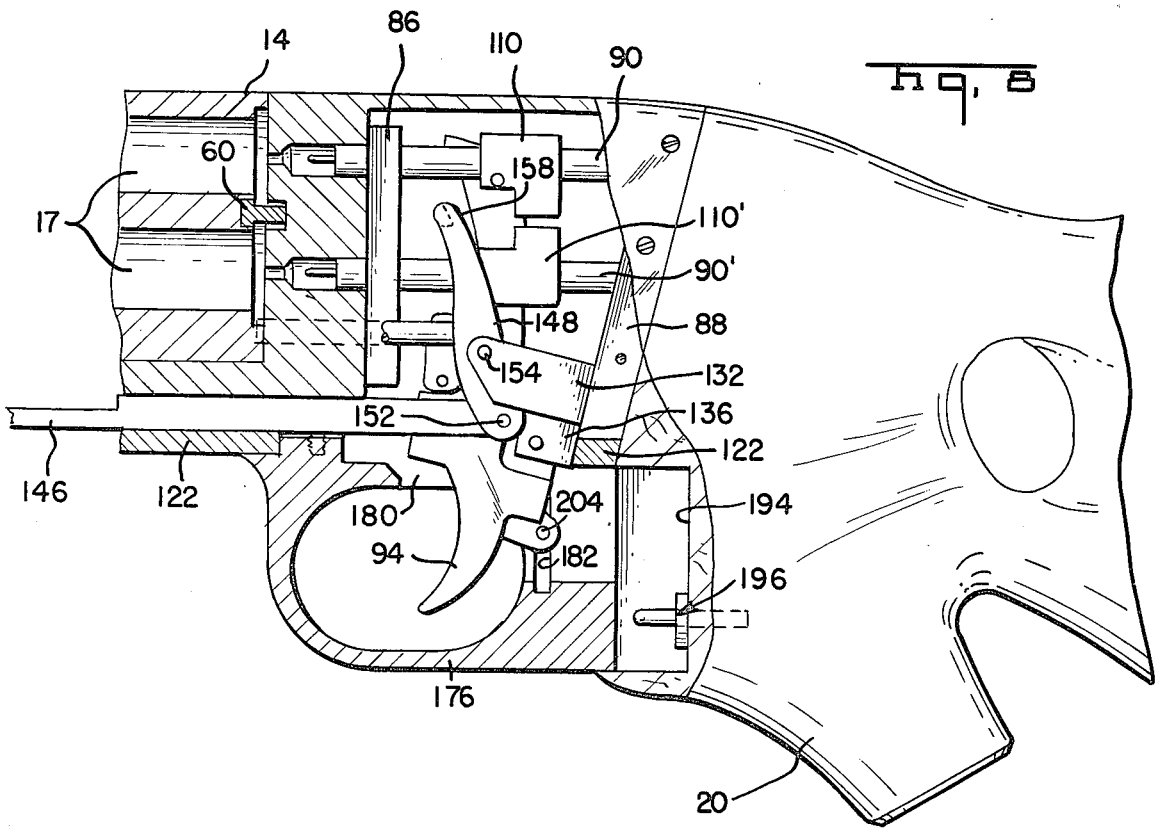
FIG. 8 is a fragmentary opposide-side elevational view, with some components partially broken away, of the mid-section of the gun.
Figure 7:
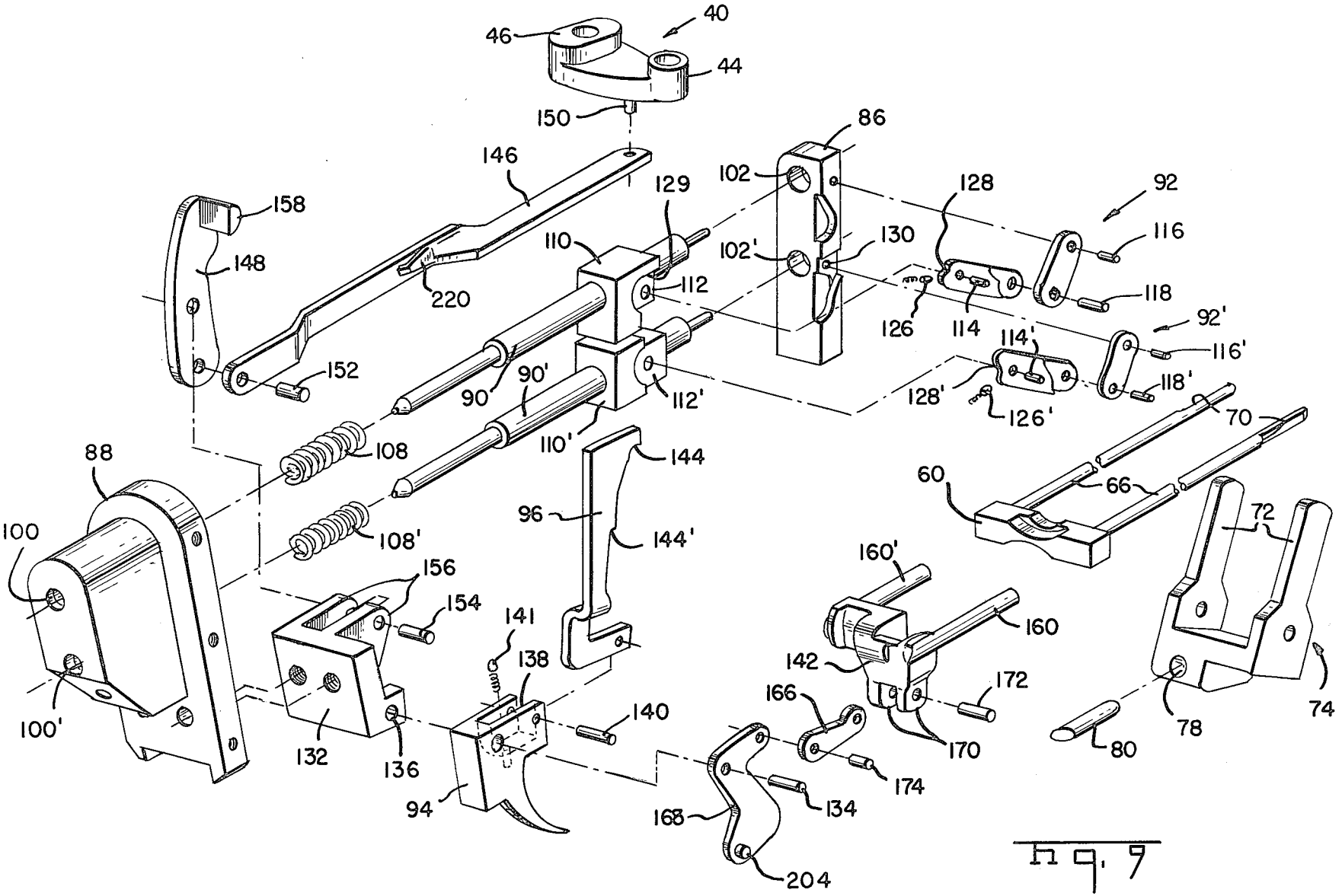

Upon rearward movement of firing pins 90, 90' to their fully retracted "cocked" positions, toggle linkages 92, 92' assume extended "locked" positions as shown in FIGS. 4 and 6 and wherein the axes of center pins 118, 118' lie slightly above the top dead center planes of the respective linkages. While resulting primarily from their connections to firing pin blocks 110, 110', movement of linkages 92, 92' to their extended positions is assisted in its final phase by small spring-biased plunger assemblies 126, 126' (FIGS. 6 and 9) carried by block-like members 110, 110' and projecting into the link-receiving recesses 112, 112' of such members. Plungers 126, 126' engage notched end surface portions 128, 128' (FIG. 9) of the rear links of toggle linkages 92, 92' when such linkages are almost fully extended and, following such engagement, bias the toggle linkages to their fully-extended positions of FIGS. 4 and 6. Movement of upper toggle 92 beyond its aforesaid fully-extended position is prohibited by then-ensuing abutment of the upper surface of its rearmost link with an overlying shoulder 129 (FIG. 9) of block-like member 110. Movement of lower toggle linkage 92' beyond its fully-extended position is similarly prevented by then-ensuing abutment between an upper surface of its forwardmost link with an overlying shoulder 130 (FIG. 9) of base member 86.

Firing pins 90, 90' are maintained in their retracted "cocked" positions, and cannot be projected forwardly by the then-compressed springs 108, 108' encircling their rear end portions, as long as toggle linkages 92, 92' continue to occupy their fully-extended positions of FIGS. 4 and 6. However, when the center pin 118 or 118' of linkage 92 or 92' is moved slightly downwardly through the top dead center plane of the linkage of which it forms a part, collapse of such linkage and forward projection of the associated firing pin 90 or 90' immediately ensues in response to the biasing force imposed upon such pin by spring 108 or 108'. This of course causes firing of shotgun 10, assuming the same is then in a loaded condition. The firing mechanism components by which the foregoing result is achieved, when firing of the gun is desired, include trigger member 94 and lever member 96. Trigger 94 is connected to rearward base member 88 of the firing mechanism by a bracket 132 formed integral with or (as shown) fixedly connected to the forward lower surface of member 88, and by a pin 134 that projects through aligned bores provided within an upper portion of trigger 94 and within a pair of laterally spaced ears 156 projecting forwardly from bracket 132 on opposite sides of the upper portion of trigger member 94. Trigger member 94 is pivotably movable about the generally horizontally extending axis of pin 134 in response to a pull upon the arcuate lower portion thereof that projects downwardly from breech member 12 through an opening 120 (FIG. 15) within a removable frame plate 122 underlying recess 42 of member 12. The lower end portion of firing lever 96 is mounted within an upwardly opening slot 138 (FIG. 9) in the upper portion of trigger 94 by a pivot pin 140 that extends through aligned bores within the aforesaid components. The bottom surfaces of lever 96 and slot 138 are spaced from each other to permit bidirectional limited pivotal movement of lever 96 about the axis of pin 140 between forwardly and rearwardly inclined positions. A spring assembly 141 carried by trigger member 94 and projecting upwardly through the bottom surface of its slot 138 engages the undersurface of lever 96 and biases the same in a clockwise direction about the axis of pin 140. The upper part of lever 96 is disposed within a vertical plane that extends closely adjacent the right sides of toggle linkages 92, 92' and that intersects the projecting end portions of center pins 118, 118' of such linkages. Within the forward edge of lever 96 are vertically spaced notches 144, 144' adapted to cooperate with respective ones of the pins 118, 118'. When shotgun 10 is fully cocked and ready for firing, the pivotal position of lever 96 about the axis of pin 140 is such that, as shown in FIG. 4, the lever extends substantially vertically. Lever 96 is maintained in its FIG. 4 operative position by the clockwise biasing force imposed upon it by spring assembly 141 and by then-ensuring engagement of a part of its forward edge with the projecting end portion of center pin 118 of upper toggle linkage 92. Pulling of the arcuate lower portion of trigger 94 moves lever 96 downwardly causing its upper notch 144 to descend into engagement with center pin 118 of upper toggle linkage 92 and to downwardly displace such pin below the linkage's top dead center plane. As soon as this occurs, toggle linkage 92 collapses and upper firing pin 90 is projected forwardly by spring 108 to fire the upper barrel 16 of shotgun 10, assuming it then is loaded. Once upper toggle linkage 92 has collapsed, lever 96 pivots (about the axis of pin 140 and under the impetus of spring assembly 141) to a forwardly inclined operative position in which it is halted by engagement of that part of its forward edge immediately above notch 144' with the projecting end portion of center pin 118' of lower toggle linkage 92'. Upon release of trigger 94, it and lever 96 are automatically moved by the spring assembly 141 to their positions of FIG. 7, wherein trigger 94 is again forwardly disposed and notch 144' of lever 96 engages and directly overlies the projecting end portion of center pin 118' of lower toggle linkage 92'. Another pull upon the arcuate lower portion of trigger 94 therefore causes lower notch 144' of lever 96 to downwardly displace the projecting end portion of center pin 118', thereby effecting collapse of lower toggle linkage 92' and firing of the lower barrel 16 of gun 10 by firing pin 90'. Upon collapse of lower toggle linkage 92', lever 96 pivots a slight distance further forwardly, about the axis of pin 140, into engagement with the rear surface of a bracket 142 forming part of the subsequently described breech locking mechanism of gun 10.

The cocking mechanism of shotgun 10 includes (see FIGS. 9–11, 13 and 14) a generally horizontally extending lever 146 disposed within undersurface recess 42 of breech member 12, and a cooperating lever 148 that extends generally vertically within the rear cavity of such breech member. The forward end portion of lever 146 is pivotably connected to the previously described plate member 40 within recess 42, by a stud 150 projecting downwardly from the plate. A pivot pin 152 interconnects the rear end portion of lever 146 with the lower end portion of lever 148, and a pivot pin 154 mounts a medial portion of lever 148 between forwardly projecting ears 156 of the bracket 132 connected to the lower front portion of member 88. A laterally extending arm 158 upon the upper end of lever 148 projects between firing pins 90, 90' forwardly of the block-like members 110, 110' thereon, and has a substantially flat rear face confronting and adapted to engage portions of the forward faces of block members 110, 110' during operation of the cocking mechanism. Opening of the breech assembly of shotgun 10 moves horizontally extending lever 146 forwardly within recess 42, as is indicated by the directional arrows in FIG. 14, due to the connection between such lever and plate 40. The forward movement of lever 146 pivots lever 148 about the axis of pin 152 in a direction (clockwise, as viewed in FIG. 8) imparting rearward movement to the arm 158 upon the upper end of lever 148. If either or both firing pins 90, 90' are uncocked, the rearwardly moving arm 158 of lever 148 restores the same to a cocked condition by engaging and then rearwardly displacing the block 110 and/or 110' thereon. When firing pins 90, 90' occupy their fully-retracted cocked positions, they are maintained in such positions, as previously described by then fully-extended toggle linkages 92, 92' associated therewith. Closing of the breech assembly of shotgun 10 imparts return rearward movement to the lever 146 within recess 42, as indicated by the directional arrow in FIG. 13, which in turn forwardly displaces arm 158 of lever 148 to a position (FIG. 8) wherein the same will not impede forward projection of either firing pin 90, 90' when shotgun 10 is fired.

A breech-locking mechanism, which includes the previously mentioned bracket member 142 (FIGS. 4 and 6–9), is provided to prevent opening of the breech assembly of shotgun 10 except at desired times. Bracket member 142 is mounted within breech member 12 above trigger 94 for movement from a rearward or retracted position, as shown in FIG. 6, to a forward or extended position shown in FIGS. 4, 7 and 8. When bracket 142 occupies its forward position, pins 160, 160' fixedly secured to its opposite sides project forwardly through respective aligned bores 162, 162' (FIG. 3) within wall 24 of breech member 12, and into bores 164, 164' (FIG. 2) within rear surface 26 of breech member 14. This of course prevents opening of the breech assembly of shotgun 10. Rearward movement of bracket 142 to its position of FIG. 6 retracts pins 160, 160' from bores 164, 164' of breech member 14 and permits pivotal movement of such breech member to its open position of FIG. 2. During movement of bracket member 142 to its FIG. 6 position, the rear surface of the bracket engages a lower portion of the front edge of lever 96 of the firing mechanism of shotgun 10, and pivots such lever rearwardly, against the biasing force imposed upon the lever by spring assembly 141, about the axis of pin 140. Lever 96 is maintained by bracket 142 in its rearwardly-pivoted inoperative position of FIG. 6, wherein the lever's forward edge is spaced relatively distal from center pins 118, 118' of toggle linkages 92, 92', whenever the breech assembly of shotgun 10 is in other than a fully closed and locked condition. At such times lever 96 therefore could not, even if moved downwardly, effect collapse of either toggle linkage 92, 92'. The means by which bracket 142 is moved between its aforesaid forward and rearward positions includes levers 166, 168 best shown in FIG. 9. One end portion of lever 166 is disposed between downwardly projecting ears 170 of bracket 142, and is pivotably connected thereto by a pivot pin 172 extending through aligned bores within the aforesaid components. The other end portion of lever 166 is pivotably connected by a pin 174 to a forward upper portion of lever 168, which is of generally S-shaped configuration. The same pivot pin 134 that mounts trigger 94 between ears 156 of bracket 132 also mounts lever 168 between such bracket ears for pivotal movement about the pin's axis. Such movement of lever 168 is in a plane closely adjacent and parallel to the right side of trigger 94, but is independent of the trigger's movement.

Figure 15:
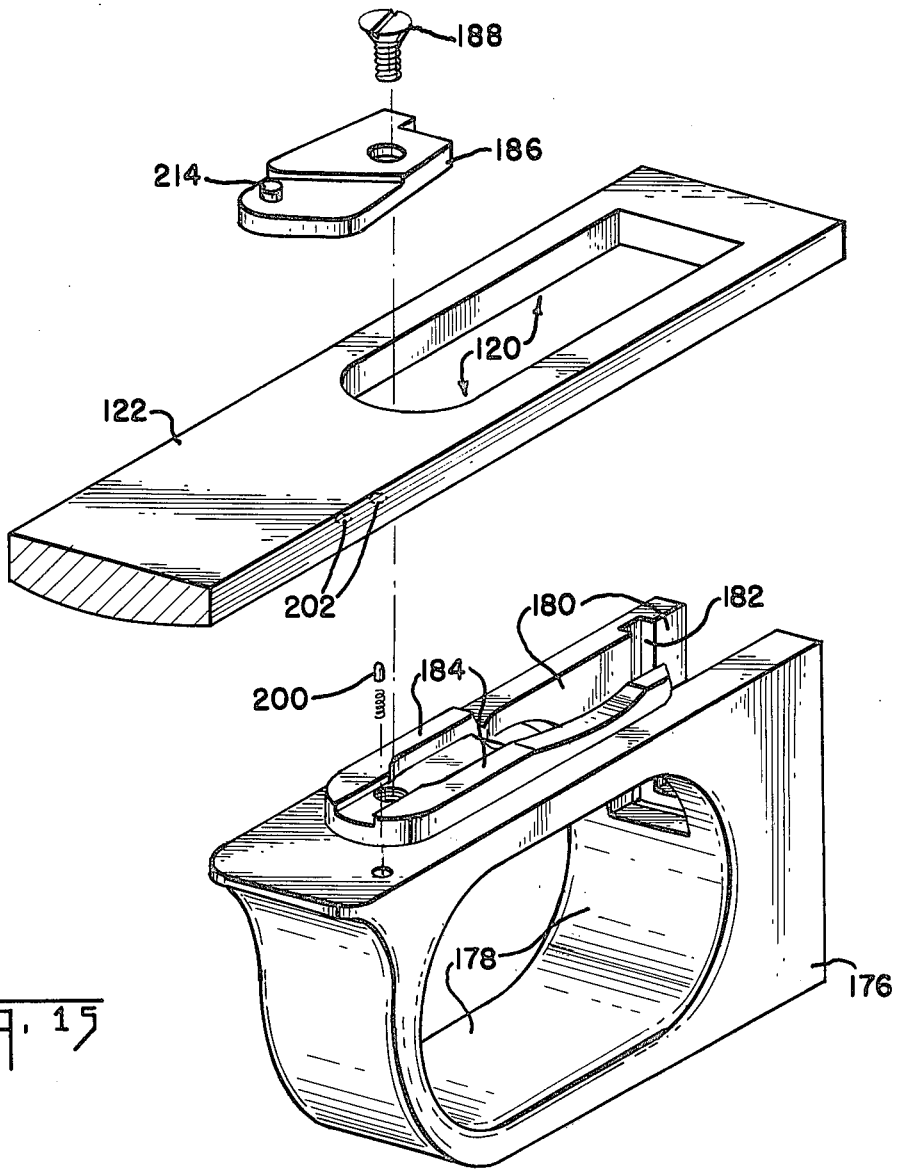
FIG. 15 is an enlarged perspective view of the trigger guard and some associated components, one of which is partially broken away, of the gun.

Operative of the breech-locking mechanism and certain aspects of the operation of the firing mechanism of shotgun 10 are controlled by a trigger guard 176 that is slidably movable longitudinally of the gun between a plurality of longitudinally-spaced positions. As is best shown in FIG. 15, trigger guard member 176 has an opening 178 of conventional oval shape extending laterally therethrough. Intermediate its width and along the rearward part of its length, trigger guard 176 also has an opening 180 that extends through its top and rear surfaces and communicates with oval opening 178. A cam slot 182 extends vertically through one side surface of opening 180. Trigger guard 176 underlies and is slidably movable in the length direction of removable frame plate 122 of breech 12, at a location thereon such that the arcuate part of trigger 94 depending downwardly through opening 120 of frame plate 122 projects through opening 180 and into oval opening 178 of trigger guard 176. Trigger guard 176 is mounted for such movement by upstanding rib-like members 184 upon its upper surface that slidably engage opposite side edges of opening 120 of frame plate 122; and by a clamping plate 186, secured to trigger guard 176 by a screw 188, that overlies and is slidable along that part of the upper surface of frame plate 122 immediately forwardly of its opening 120. A recess 194 (FIGS. 4–8) within buttstock 20 of shotgun 10 slidably receives the rear part of trigger guard 176. A spring-plunger assembly 196 mounted within recess 194 engages the rear of trigger guard 176 and biases the trigger guard forwardly to the position thereof shown in FIG. 5. When trigger guard 176 occupies its FIG. 5 position, an upper portion 177 thereof so closely underlies an upper shoulder-like portion 198 of trigger 94 as to then prohibit, by its abutting engagement with shoulder 198, trigger 94 being pulled rearwardly to effect firing of shotgun 10. The gun is therefore in a "safe" condition as long as trigger guard 176 remains in the FIG. 5 position to which it is biased by plunger assembly 196. To place shotgun 10 in a condition of readiness for firing, trigger guard 176 is slid forwardly from its FIG. 5 position to a forwardmost position shown in FIGS. 4, 7 and 8. When trigger guard 176 occupies its forwardmost position, its opening 180 underlies shoulder-like portion 198 of trigger 94. The trigger may therefore be pulled to effect firing of gun 10. Since the plunger of assembly 196 is fully extended when trigger guard 176 occupies its FIG. 5 position, movement of the trigger guard to its position of FIGS. 4, 7 and 8 must be accomplished by a user of shotgun 10 manually sliding the trigger guard in a forward direction. Such movement of trigger 176 can and normally would be accomplished by the user of shotgun 10 inserting his trigger finger within the trigger guard's oval opening 178 and moving such finger a slight distance forwardly. Rapid firing of shotgun 10 can then quickly be effected since the user's trigger finger is already positioned within oval opening 178 of trigger guard 176 and need only be moved in a rearward direction to pull trigger 94. On the other hand, return rearward movement of trigger guard 176 from its forward "ready to fire" position (FIGS. 4, 7 and 8) to its "safe" position (FIG. 5) normally would be accomplished by the user of shotgun 10 removing his trigger finger from oval opening 178, and therefore from proximity with trigger 94. This reduces if not altogether obviates the possibility of the user of shotgun 10 inadvertently pulling trigger 94 while returning trigger guard 176 to its "safe" position of FIG. 5. A small spring-biased detent 200 (FIGS. 12 and 15) mounted within and projecting from the upper surface of trigger guard 176 is received within one or the other of a pair of cooperating concave seats 202 within the undersurface of frame plate 122 when trigger guard 176 occupies either its position of FIG. 5 or its position of FIGS. 4, 7 and 8, and prevents spontaneous free movement of the trigger guard from such position.

Figure 5:
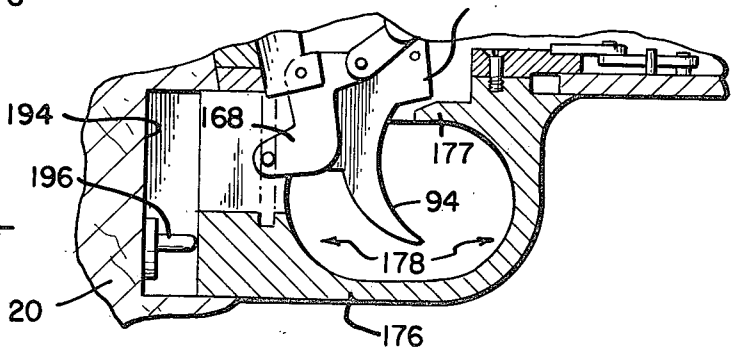
FIG. 5 is a fragmentary, partially broken-away, side elevational view showing the trigger guard, and some immediately adjacent components of the gun, in an intermediate position.

In addition to being movable forwardly from its FIG. 5 position, as previously described, trigger guard 176 is also slidably movable rearwardly from such position to a position illustrated in FIGS. 6 and 11. Movement of trigger guard 176 to its rearmost position of FIGS. 6 and 11 cannot occur inadvertently since it requires that the user of gun 10 impose a pulling force upon the forward surface of the trigger guard of a sufficient magnitude to effect retraction of the spring-biased plunger of the assembly 196 within buttstock recess 194. This is desirable since movement of trigger 176 to its rearward position of FIGS. 6 and 11 retracts the breech locking mechanism of shotgun 10 and thus permits opening of its breech assembly. More specifically in the foregoing regard, a stud-like follower element 204 (FIG. 9) upon the lower end portion of breech-locking mechanism lever 168 is received within cam slot 182 of trigger guard 176. As the trigger guard is moved rearwardly from its FIG. 5 and to its FIG. 6 position, engagement of follower 204 by cam slot 182 effects clockwise (as viewed in FIGS. 5 and 6) pivotal movement of lever 168 about the axis of pin 134. This in turn causes lever 166 and bracket 142 to retract breech locking pins 160, 160' from bores 164, 164' of breech member 14. As previously described, the aforesaid retraction of the breech locking mechanism simultaneously moves firing-mechanism lever 96 to an inoperative position distal from center pins 118, 118' of toggle linkages 92, 92'. This places shotgun 10 in a "double-safe" condition since when trigger guard 176 occupies its rearward position, the upper portion 177 thereof then still also underlies shoulder 198 of trigger 94.

Upon movement of trigger guard 176 to its rearmost position of FIGS. 6 and 11, it is automatically secured in such position pending opening and closing of the breech assembly of gun 10. This allows the user of gun 10 to employ both hands for reloading or other purposes. The means securing trigger guard 176 in its rearmost position comprises (see FIGS. 6, 10, 11 and 15) a toggle linkage 205 disposed within bottom recess 42 of breech member 12 and consisting of links 206, 208 having their adjacent end portions pivotably innerconnected by a pin 210. The forward end portion of link 208 is pivotably connected to frame plate 122 by a pin 212 projecting upwardly from such plate. The rear end of pin 206 is pivotably connected to an upstanding pin 214 (FIG. 15) of the plate 186 affixed to trigger guard 176. Toggle linkage 205 normally is in a collapsed condition as shown in FIG. 10. Movement of trigger guard 176 to its rearmost position extends linkage 205, due to the simultaneously ensuing rearward movement of the plate 186 to which link 206 is connected. Such extension of linkage 205, in conjunction with a small-magnitude biasing force exerted thereon by a tension spring 216 innerconnecting its link 208 and an upstanding stud element 218 upon frame plate 122, displaces center pin 210 through the linkage's top dead center plane. Further movement of linkage 205 beyond its fully extended position of FIG. 11 is prohibited by then-ensuing abutment between link 208 and stud 218, and linkage 205 therefore then prohibits return forward movement of trigger guard 176. Toggle linkage 205 and trigger guard 176 remain in their position shown in FIGS. 6 and 11 pending opening and closing of the breech assembly of shotgun 10. During closure of the breech assembly of gun 10, its cocking-mechanism lever 146 undergoes rearward movement, as previously described. During that final phase of the rearward movement of lever 146 that occurs just as the breech assembly of gun 10 becomes fully closed, a spur-like projection 220 upon such lever engages a projection 206' upon toggle link 206 and pivots such link in a counterclockwise direction (as viewed in FIGS. 10 and 11) sufficiently to return center pin 210 of linkage 205 back through the linkage's top dead center plane. As soon as this occurs, toggle linkage 205 collapses and trigger guard 176 returns to its position of FIGS. 5 and 10 under the impetus of the biasing force imposed thereon by spring-plunger assembly 196. Such return forward movement of trigger guard 176 in turn restores bracket 142 of the breech locking mechanism to its normal position, thereby causing pins 160, 160' to then again project into bores 164, 164' of breech member 14 and firing-mechanism lever 96 to then again be disposed closely adjacent center pin 118 of firing-mechanism toggle linkage 92.

Although a preferred embodiment of the invention has been specifically shown or described, this was for purposes of illustration only, and not for purposes of limitation, the scope of the invention being in accordance with the hereinafter presented claims.

That which is claimed is:

1. In a breech-loading firearm having a frame; an extendable and retractable breech-locking mechanism effective when extended to prevent opening of the breech assembly of said firearm, and when retracted to permit opening of said breech assembly; a firing mechanism including a trigger having a lower portion extending downwardly from said frame and adapted to be pulled rearwardly to actuate said firing mechanism; and a trigger guard encircling said lower portion of said trigger; the improvement comprising:

mounting means mounting said trigger guard upon said frame for sliding movement of said trigger guard longitudinally of said frame between first, second and third spaced positions;

and cooperating means operatively associated with said trigger guard and with said firing and breech-locking mechanisms for retracting said breech-locking mechanism in response to movement of said trigger guard to its said first position, for extending said breech-locking mechanism and preventing operation of said firing mechanism in response to movement of said trigger guard to its said second position; and for permitting operation of said firing mechanism upon movement of said trigger guard to its said third position.

2. A firearm as in claim 1, wherein said prevention of the operation of said firing mechanism is achieved in one manner by said cooperating means when said trigger guard occupies its said second position, and said cooperating means prevents operation of said firing mechanism in said one manner and also in another manner when said trigger guard occupies its said first position.

3. A firearm as in claim 1, wherein said first and third positions of said trigger guard are respectively rearwardly and forwardly of said second position thereof; and further including biasing means for biasing said trigger guard forwardly from its said first position and to its said second position.

4. A firearm as in claim 3, wherein said frame of said firearm includes a buttstock having a recess therein receiving a rearward portion of said trigger guard; and wherein said biasing means is carried by said buttstock and engages said rearward portion of said trigger guard member.

5. A firearm as in claim 1, and further including biasing means for biasing said trigger guard from its said first position and to its said second position; and releasable retaining means operable in response to movement of said trigger guard to its said first position for retaining said trigger guard in its said first position pending opening and closing of said breech assembly of said firearm.

6. A firearm as in claim 5, and further including a cocking mechanism for cocking said firing mechanism in response to opening of said breech assembly of said firearm; said cocking mechanism including an elongate lever member movable in its length direction in response to opening and closing of said breech assembly; and means carried by said lever member and engagable upon closing of said breech assembly with said retaining means for thereby then releasing said retaining means and effecting movement of said trigger guard by said biasing means from its said first position to its said second position.

7. A firearm as in claim 6, wherein said retaining means comprises an extendable and collapsable toggle linkage connected adjacent one end to said trigger guard and adjacent its other end to said frame of said firearm, said toggle linkage being extended by movement of said trigger guard to its said first position and being effective when extended to maintain said trigger guard assembly within its first position; and wherein said means upon said cocking lever engages and collapses said toggle linkage upon closing of said breech assembly of said firearm.

8. A firearm as in claim 1, wherein said cooperating means includes an upper portion of said trigger, and a cooperating upper portion of said trigger guard; said upper portion of said trigger guard being disposed in closely underlying relationship to said upper portion of said trigger and blocking movement thereof when said trigger guard occupies its said second position.

9. A firearm as in claim 1, wherein said firing mechanism further includes a firing pin movable axially between a forward firing position and a rearward cocked position; biasing means biasing said firing pin to its said forward position; an extendable and collapsable toggle linkage connected to said firing pin for when extended maintaining said firing pin in its said rearward cocked position; a lever connected to and extending upwardly from said trigger for movement therewith during operation of said firing mechanism, and for movement at other times relative to said trigger between operative and inoperative positions; said firing lever when in its said operative position being effective to engage and collapse said toggle linkage upon pulling of said lower portion of said trigger, and said firing lever when in its said inoperative position being incapable of effecting collapse of said toggle linkage; and wherein said cooperating means effects movement of said firing lever to its said inoperative position in response to movement of said trigger guard to its said first position.

10. A firearm as in claim 1, wherein said breech locking mechanism includes a bracket member disposed within said frame above said trigger guard; a pair of breech locking pins carried by said bracket member and projecting forwardly from opposite sides thereof through aligned bores within said breech assembly of said firearm, said bracket member being movable forwardly and rearwardly to respectively extend and retract said breech locking pins; linkage means connected to said bracket member and including a lever member disposed adjacent said trigger guard; and wherein said cooperating means includes cam means innerconnecting said lever member and said trigger guard for causing said linkage means to move said bracket member rearwardly in response to movement of said trigger guard to its said first position, and for causing said linkage means to move said bracket member forwardly in response to movement of said trigger guard from said first position to said second position thereof.

11. A firearm as in claim 10, wherein said cam means includes a generally vertically extending cam slot within said trigger guard; and a follower element projecting from said lever member and into said cam slot of said trigger guard.

12. A firearm as in claim 11, wherein said firing mechanism includes a firing lever connected to said trigger for movement from an operative position, normally occupied by said firing lever, to an inoperative position; said firing lever extending closely adjacent said cocking-mechanism bracket member and being maintained thereby in its said inoperative position while said trigger guard occupies its said first position.

* * * * *